US005469770A

United States Patent [19]

Taylor

[11] Patent Number: 5,469,770

[45] Date of Patent: Nov. 28, 1995

[54] DISTRIBUTED LOAD SOUNDBOARD SYSTEM

[76] Inventor: Ben D. Taylor, 450 First Avenue, NW., Carmel, Ind. 46032

[21] Appl. No.: 303,423

[22] Filed: Sep. 9, 1994

[51] Int. Cl.[6] ..... G10D 3/00

[52] U.S. Cl. ..... 84/291; 84/293

[58] Field of Search ..... 84/267, 192, 291, 84/293

[56] References Cited

U.S. PATENT DOCUMENTS

| | | | |
|---|---|---|---|
| 1,633,574 | 6/1927 | Dewey | 84/267 |
| 3,425,308 | 2/1969 | Astin et al. | 84/192 |
| 3,443,465 | 5/1969 | Kasha | 84/267 |
| 3,656,395 | 4/1972 | Kaman | 84/267 |
| 3,685,385 | 8/1972 | Rendell | 84/267 |
| 4,027,570 | 6/1977 | Rendell et al. | 84/293 |
| 4,031,798 | 6/1977 | Sidner | 84/291 |
| 4,056,034 | 11/1977 | Kaman | 84/267 |
| 4,155,284 | 5/1979 | Graves | 84/187 |
| 4,206,678 | 6/1980 | Guerrero | 84/267 |
| 4,248,124 | 2/1981 | Klaiber et al. | 84/192 |
| 4,320,684 | 3/1982 | Podunavac | 84/291 |
| 4,391,177 | 7/1983 | Grajek et al. | 84/196 |
| 4,873,909 | 10/1989 | Humphrey | 84/293 |
| 5,170,000 | 12/1992 | Hayashida et al. | 84/192 |
| 5,233,122 | 8/1993 | Kim | 84/293 |
| 5,381,714 | 1/1995 | Kasha | 84/276 |

*Primary Examiner*—Patrick J. Stanzione
*Attorney, Agent, or Firm*—Barnes & Thornburg

[57] ABSTRACT

A soundboard apparatus for a stringed musical instrument includes a soundboard having first and second side surfaces, a bridge coupled to the first side surface of the soundboard for securing a plurality of strings to the soundboard, and a plurality of braces coupled to the second side surface of the soundboard. The plurality of braces are configured to intersect at a point located directly below the bridge to strengthen the soundboard adjacent the bridge. In the illustrated embodiment, the plurality of braces are mirror symmetrical about an axis of symmetry extending through the bridge. An adjustable locking apparatus is also provided for securing a neck to a body of a stringed musical instrument. The locking apparatus includes a first track member located on the neck, and a second track member located on the body. The second track member is formed to slidably engage the first track member to align the neck in a selected position relative to the body. The apparatus also includes a fastener for holding the first and second track members in the selected position to secure the neck relative to the body and a fastener to allow tightening of the track members.

28 Claims, 11 Drawing Sheets

DISTRIBUTED LOAD SOUNDBOARD SYSTEM

BACKGROUND AND SUMMARY OF THE INVENTION

The present invention relates to a lightweight, distributed load, high efficiency soundboard system for use with stringed musical instruments. More particularly, the present invention relates to improvements in bracing patterns and soundboard design for use on instruments such as the classical and steel string guitars, lute, mandolin, violin family instruments, piano, harpsichord and harp family instruments. In addition, the present invention relates to a stringed musical instrument of the guitar, violin and mandolin family having a removable and adjustable neck system including an adjustable sliding locking mechanism so that the height of strings relative to a fingerboard may be adjusted and to allow for tension balancing adjustments.

The improved soundboard bracing system is designed for use with traditional tone woods or man made materials. Advantageously, use of the improved soundboard bracing systems with traditional tonewoods provides unified long grain strength while overcoming inherent cross grain weakness. The disclosed invention provides a soundboard system that delivers excellent acoustic projection characteristics without undesirable free vibrational mode overtones. The soundboard system is most rigid where the transfer coupling for string tension loads are delivered and progressively less rigid to the outermost edges of the soundboard.

Even the earliest of stringed musical instruments used soundboards made of thin flat plates of lightweight quarter-sawn woods such as pine, spruce and cedar, with the grain of the wood running parallel to the strings for increased strength. The strings of these early instruments were attached to a small piece of wood called a bridge. Most often the bridge wood was selected of hardwood and glued to the top side of the soundboard, except in the cases of instruments where the strings were to be anchored to a tail piece or to the bottom end of the instrument. Where tail anchored or tail piece anchored strings were used the bridge was often not glued in place but held in place by the angled string pressure itself on the bridge, as is found in the violin family instruments, mandolins and arched top guitars of today.

The other end of the strings were attached to tuning pegs or other devices to tension the strings to the desired pitch. The tuning devices were to be found on the head of the instruments such as the lute, guitar, mandolin and violin at the opposite end of the neck from the body. The neck of the instrument was attached to the body of the instrument with the soundboard as its top. When the instruments were tuned, high forces were applied to the soft thin soundboard woods from the bridge due to string tension. Over time soundboard deformation often occurred. Also, force from the deformation could split or crack the wood usually parallel with the long grain.

Early instruments often used braces glued across the grain of the soundboard to strengthen the wood especially where experience indicated a likelihood of deformation or cracks. The size of the cross braces had to be selected carefully. If the braces were too small deformation could still occur. If the braces were too large, wave energy could be "stopped" or reflected away from the heavy brace having the effect of limiting the size of the active portion of the soundboard. A large instrument braced with braces that were too heavy could sound "small". Ancient stringed instruments with cross braced soundboards did not produce the volume and tone required in modern day instruments.

Over the centuries improvements to the art were made to make the instruments louder and more sonorous. During the period between 1550 and 1750, instruments of the violin family were improved and according to many authorities, perfected. These instruments employed a soundboard that was carved by hand into a vaulted arched shape where the load of the string tension was distributed over a wide surface area. In the case of the violin family, two other soundboard inventions were brought into play. The first was a bass bar which is a brace of wood running nearly parallel with the grain of the soundboard and located under the bass foot side of the bridge. The second was a sound post which is a rod of wood wedged between the soundboard and the back of the instrument very near the underside of the treble foot of the bridge. The bass bar was glued onto the soundboard with some pre-load, whereby the curve of the bass bar was greater than the curve of the inside surface of the soundboard so that when glued in place the soundboard is reinforced by a springing action. When properly fitted, the sound post not only aids in the support of the treble bridge foot but also serves to adjust the tonal quality of the instrument by its placement.

The soundboard inventions used in the violin family have worked extremely well with the large amounts of energy supplied by bowing excitation. However, when violin family strings are plucked by fingers the sounds produced do not sustain well.

As early as 1783, Josef Benedit of Cadiz, Spain was building guitars with thin flat soundboards 2 illustrated in FIG. 1 incorporating an invention called "fan bracing". These fan braces 4 were long thin pieces of wood with uniform thickness and height. Usually fan braces 4 were spaced closer together near the soundhole 10, gradually wider towards the bridge location 6 and even wider the braces 4 fan out behind the bridge 6. The volume and tone of such fan braced guitars was an improvement over crossed braced instruments. Fan bracing also provided better load distribution of string tension from the bridge 6 over the soundboard 2. By 1854, Antonio de Torres of Seville, Spain was building larger guitars with very thin soundboards braced with seven fan braces 4 and two stop braces 12 as also illustrated in FIG. 1. Two additional large stop braces 8 were added to isolate the active portion of the soundboard 2 from the soundhole 10. Guitars built today with bracing patterns as shown in FIG. 1 are called "Torres braced" after Antonio de Torres. Although the invention of nylon strings has changed the sounds produced from that of gut strings used in Torres' time, the modern classical guitar is basically the same instrument only somewhat improved since the 1850s.

Over years of string tension Torres style soundboards tend to crown up behind the bridge letting the bridge tilt forward so the guitar begins to play more and more out of tune while the strings begin to raise from the fingerboard until the guitar becomes too difficult to play. Fan braces act much like floor joists used in home construction. If joists or braces are placed closer together then the surface being braced is stronger. With Torres bracing, the fans are closer together near the soundhole so that the plate can be considered stronger in this area than where the braces fan out behind the bridge. However, in front of the bridge the Torres bracing pattern exhibits undesirable increasing resistance to flexing which has the effect of stopping wave energy and limiting the active portion of the soundboard. As the long braces gradually cross many of the long grains of the soundboard the normal cross grain weakness of the plate is somewhat overcome so that the soundboard acts more as a unified sound source than when no long grains are crossed. Some modern guitar makers use a bracing pattern that simply has several braces in parallel with the long grain of the plate. Although these simple parallel braces cause the strength of the plate to be equalized near the sound hole and behind the bridge, cross grain weakness has not been assisted. While some of the parallel braced guitars may seem loud to the player, most often Torres braced guitars will project better in a large room because of their more unified plate area sound source.

Between 1840–1850, Christian F. Martin of Nazareth, Pa. and others were building gut string guitars with what is now call "X-braced" soundboards as illustrated in FIG. 2. These guitars were primarily parlor guitars. The X-bracing 12 provided a strong soundboard 14 with more resistance to the crowning up problems associated with the ancient simple cross braced soundboards. It was not until the 1920s that the X-bracing pattern soundboards 14 were beginning to be used with steel strings. In 1929, the Martin Co. introduced a new OM (orchestra Model) guitar with steel strings on a X-braced soundboard with the neck of the guitar mounted at the 14th fret at the body instead of the traditional 12th fret mounting. In 1931, the Martin Co. introduced a large body 14th fret mounted X-braced steel string guitar called the D model or Dreadnought. FIG. 2 shows the most common bracing pattern used today on the modern steel string guitar soundboard 14. Very little has been changed from the 1930s. The steel string guitars of today have mostly large bodies with 14th fret mounted necks. Nearly all steel string guitars of today use two large crossed braces 12 with a single sound hole stop brace 16 located adjacent soundhole 17. One or two diagonal braces 18 are commonly used to limit the active portion of the soundboard 14 so that the larger portion of active surface is available to the bass side and the smaller to the treble. A bridge reinforcement plate 20 is glued to the underside of the soundboard directly below the bridge 22 glued to the top side of the soundboard 14. The remaining small braces strengthen the soundboard where cracking might otherwise occur. The X-braces 12 are usually built heavy enough to be considered stop braces during normal playing. Some makers build the braces 12 just light enough to allow movement during hard playing. The most active portion of the soundboard in the modern steel string guitar is the area behind the bridge 22 and bridge reinforcement plate 20 extending to the stop braces 18. While this is the most active area it is also the most likely area to crown up and deform. When deformation happens in the active area the bridge 22 begins to tilt forward so that the guitar begins to play more and more out of tune while the strings begin to raise from the fingerboard until the guitar becomes too difficult to play.

During the 1890s, Orville Gibson of Kalamazoo, Mich. was building carved arched top guitars and mandolins designed for steel strings. Through the years many attempts have been made to produce carved soundboards for plucked string instruments with some success mostly on instruments with steel strings where a pick or plectrum is used. Examples include the carved arch top mandolin and guitars of the early 1900s through the 1930s. While arch top instruments are being built today, most makers seek to build instruments with the qualities associated with arch tops built before World War II. Essentially, two bass bars are installed on most arch top instruments, one on the bass side as in the violin family and the other on the treble side near the other bridge foot. Typically the bridge on these instruments is held in place by the downward string pressure method and not glued to the soundboard. These instruments are not very loud when played with fingers alone. For this reason these arch top instruments have not been the instruments of choice where finger style playing is desired without the aid of electronic amplification. one of the best features of these carved top instruments is their stability after years of string pressure. The arch carved into the soundboards helps to the distribute the string pressure more evenly. Less distortion and deformation occurs in these instruments compared to flat top instruments. However, the soundboards of these instruments have to be almost twice as thick as those of flat braced soundboards. This accounts for most of the reason that the carved top instruments do not respond as well to the fingers alone.

One object of the present invention is to provide an improved bracing system to permit the soundboard to be as thin as possible, thereby improving tonal character. Advantageously, the bridge size can also be reduced.

The present invention for a distributed load guitar soundboard is suitable for both classical (nylon string) and steel string guitars. Unlike the previous examples shown in FIG. 1 for the modern classical guitar and FIG. 2 for the modern steel string guitar, the distributed load soundboard system of the present invention can be constructed with fundamentally identical bracing patterns. Both guitar types are tuned to the same frequencies. The notes on both instruments are alike. Only a small increase in the size of the active braces will be required to resist the extra tension of the steel strings. Additionally the modern steel string double strung or twelve string guitar has higher string tension than the steel string six string guitar. The active braces simply are increased in size again to balance the higher string tension and the distributed load guitar soundboard works equally well for the tension of twelve strings.

The distributed load soundboard system of the present invention can be constructed of traditional tonewoods or from man made materials such as carbon graphite, expanded polystyrene plastic rigid foam or other molded plastics, polyurethane or epoxy material compounds (mineral loaded or not) or even light weight metals. Different materials will have trade-offs not normally associated with the traditional tonewoods. It may not be possible to match the rich woody sounds of a spruce or cedar soundboard with a soundboard made from expanded polystyrene foam but a guitar made of plastic could be played in the rain or even underwater if desired. A wooden soundboard may be destroyed if it is emersed in water. Also as it becomes more and more difficult to obtain the quality tonewoods that were available even 10 or 20 years ago, synthetic materials may be required to build the soundboards of the future. The distributed load soundboard of the present invention can be constructed with lesser grades of existing tonewoods and still obtain good results because of the bracing system's ability to unite a larger surface of the soundboard into active wave motion.

In the past, one of the most important arts of the luthier was to select soundboard material with extreme light weight and yet high strength. Many luthiers select material according to the traditional grain counting method. Usually guitars are built with bookmatched soundboards. Bookmatched simply means that the soundboard plate is actually made up of two pieces of wood that have been split apart by sawing and folded out so that the grain of one side is the mirror image of the other side. It is traditional to join the wood in the center of the soundboard with the close grain at the center and the grain at the outer sides gradually becoming farther apart. The center grains are often counted and graded by grains per inch with the more desirable tonewood having very close grains that are straight and gradually becoming wider to the edges. Just as with floor joists, if the grains at the center of the soundboard are closer then the board is stronger in the center. This is the reason for the grain counting method. The distributed load soundboard of the present invention can be constructed with tonewood that has wider grains than the traditional choices because the bracing itself is stronger in the center so that the tonewood plate could be made with wood that would currently not be selected. Wood that is somewhat uniform in grain width or has wider grain on the bass side and gradually becomes closer towards the treble side would work very well. In practice the soundboard plates of distributed load soundboards can be thinner than the plates of traditional soundboards. The natural resources (tonewood) can be better conserved if lesser grade woods are not wasted and if thinner wood is required.

Existing traditional bracing patterns developed for soundboards have evolved over time to produce different types of sounds. Each bracing pattern has some advantages. Generally a highly skilled luthier is able to produce instruments using these traditional patterns that is loud enough for studio or recital work. Only a few luthiers are able to produce instruments loud enough to cover a large concert hall. With the existing patterns trade-offs are inevitable even when using the best tonewoods. Often to get loud sonorous treble notes the bass frequencies are sacrificed. If the instrument is very loud to the musician it may not be loud to the audience as is the case often with bracing patterns that run truly parallel with the grain of the soundboard. Torres braced instruments and their modifications generally produce a somewhat more efficient acoustical coupling for larger rooms, however, it is also common for music played and heard near the musician at the front of a large room to become severely unbalanced when heard from the rear of the room.

The distributed load soundboard system provides for a larger surface area of the soundboard to be set into active wave motion while allowing the weight of the structure to be minimized so that soundwaves may be produced with greater efficiency. The present invention relates to improvements in bracing patterns so that balance of sound is maintained in very large halls or even out of doors.

A soundboard that is too stiff and does not allow movement will not produce sound as well as a soundboard that is allowed to move more freely. If the soundboard is too flexible, especially where the string tension is transferred to the soundboard at the bridge, deformation to the soundboard will be the result. Also a soundboard that is too thin or uncontrolled by the braces can develop undesirable free vibrational modes or overtones. The optimum condition is where the soundboard is made rigid at the bridge and becomes progressively less rigid away from the bridge in all directions so that the soundboard will move freely when excited by string vibrations but resist deformation from string tension in exact balance.

According to one aspect of the invention, a soundboard apparatus for a stringed musical instrument is provided. The apparatus includes a soundboard having first and second side surfaces, a bridge coupled to the first side surface of the soundboard for securing a plurality of strings to the soundboard, and a plurality of braces coupled to the second side surface of the soundboard. The plurality of braces are configured to intersect at a point located directly below the center of the bridge to strengthen the soundboard adjacent the bridge. In the illustrated embodiment, the plurality of braces are mirror symmetrical about an axis of symmetry extending through the bridge.

In one illustrated embodiment, the plurality of braces are catenary braces having a generally flat side surface and a curved catenary side surface. The generally flat side surfaces of the plurality of catenary braces may be coupled to the second surface of the soundboard, or alternatively, the curved catenary side surfaces of the plurality of catenary braces may be coupled to the second surface of the soundboard.

According to another aspect of the present invention, an adjustable locking apparatus is provided for securing a neck to a body of a stringed musical instrument. The apparatus includes a first track member located on the neck, and a second track member located on the body. The second track member is formed to slidably engage the first track member to align the neck in a selected position relative to the body. The apparatus also includes a fastener for holding the first and second track members in the selected position to secure the neck relative to the body.

In the illustrative embodiment, the first track member includes a male dovetail coupled to the neck and the second track member includes a mount block coupled to the body. The mount block is formed to include a female dovetail groove for slidably receiving the male dovetail. Also illustratively, the fastener includes at least one bolt extending through the mount block and engaging a threaded insert in the male dovetail to secure the male dovetail relative to the mount block. A relief slot is formed in the mount block adjacent the female dovetail groove. A clamping bolt is also provided for engaging the mount block to adjust a clamping force applied by the dovetail groove against the male dovetail.

In the illustrated embodiment, the mount block is formed to include at least one elongated slot. Each elongated slot is configured to receive a fastener therethrough. Each fastener is configured to engage a threaded insert in the male dovetail to secure the mount block relative to the male dovetail. Each fastener is slidable in the at least one elongated slot to permit adjustment of the position of the neck relative to the body.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 3:
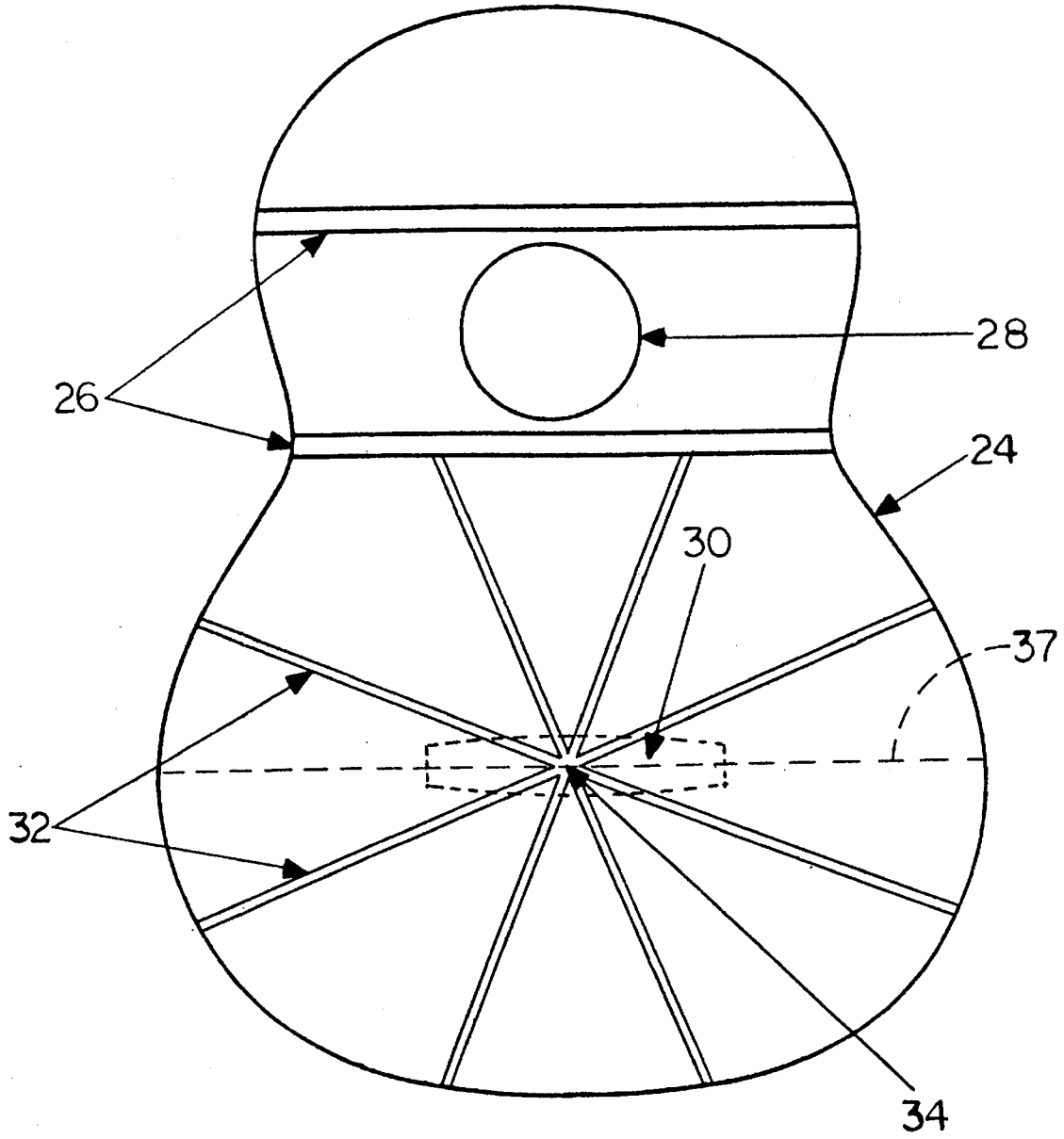
FIG. 3 is a plan view of an improved distributed load soundboard system of the present invention.
Figure 4:
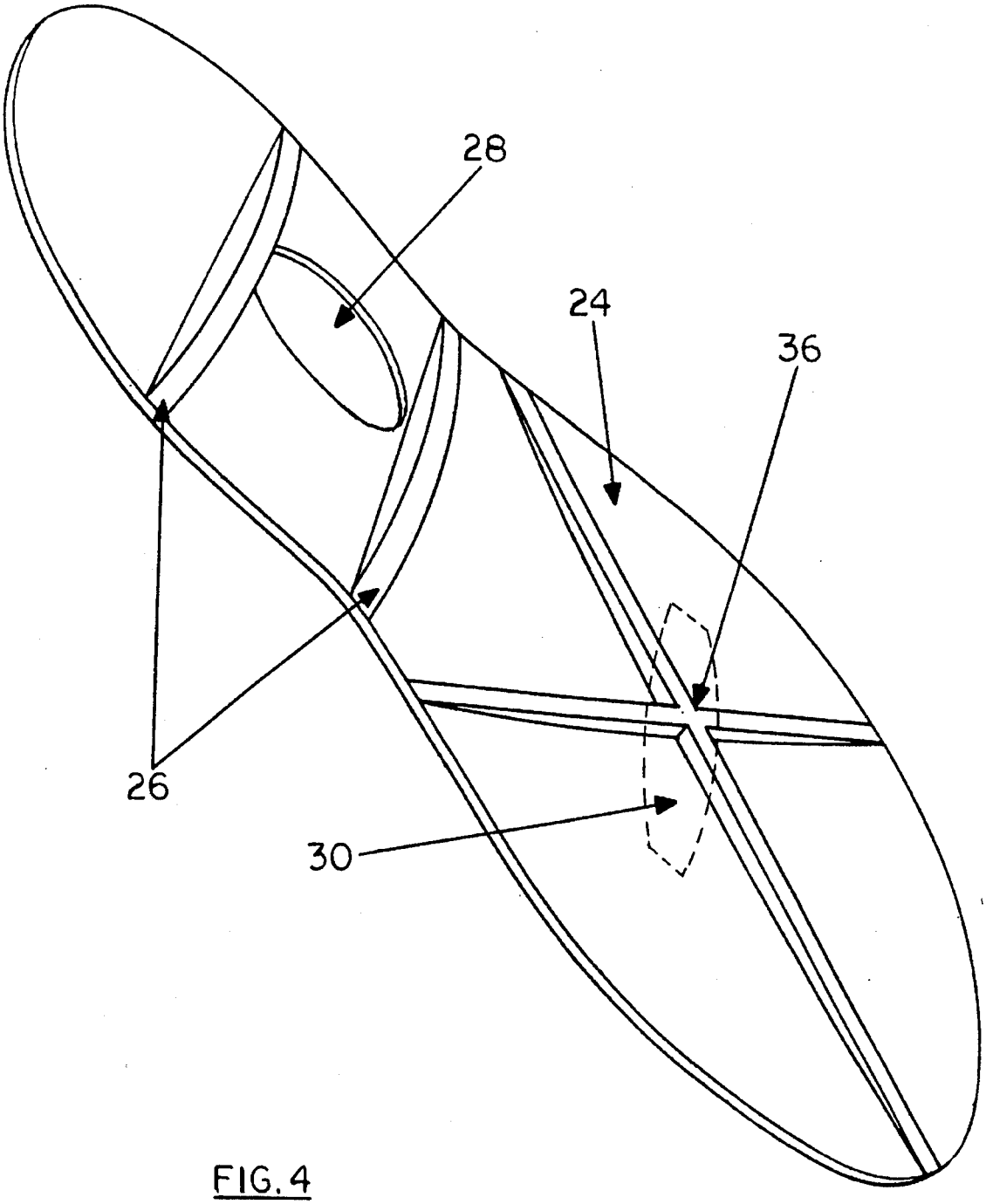
FIG. 4 is a perspective view of another embodiment of the present invention.
Figure 7:
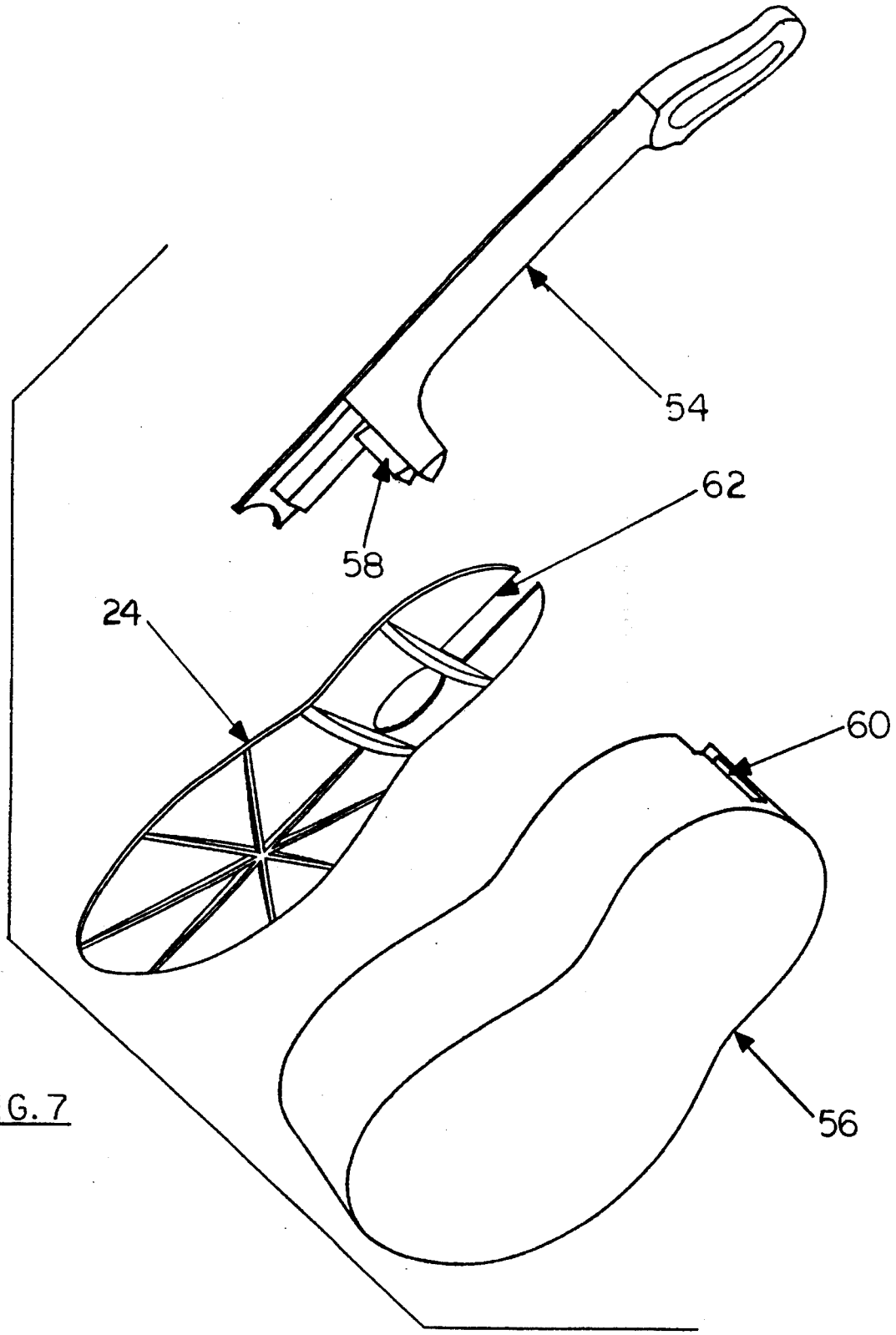
FIG. 7 is an exploded perspective view illustrating a position of the soundboard of the present invention relative to a guitar body and neck.
Figure 9:
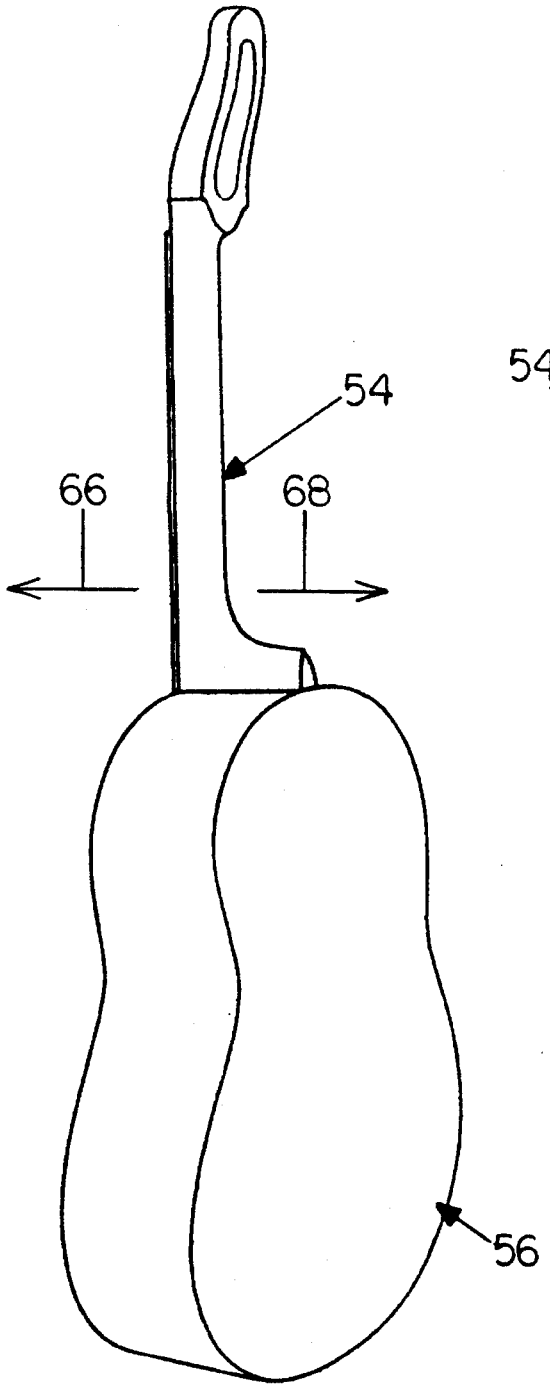
FIG. 9 is a perspective view similar to FIG. 7 illustrating slidable adjustment of the neck relative to the body.

Referring now to the remaining drawings, FIG. 3 illustrates distributed load soundboard system of the present invention. The components of the invention include the soundboard plate 24, two large stop braces 26 near a soundhole 28, a central bridge 30 mounted to a top surface of soundboard 24, and a radial system of active distribution braces 32. The long grain of the soundboard plate 24 runs generally perpendicular to the large soundhole stop braces 26. Note that this bracing pattern reinforces the long grain strength over the entire surface of the active portion of the soundboard 24. Long grains are crossed by the radiating braces 32 creating long grain unity which is not possible with traditional patterns. Braces 32 intersect at a center portion or hub 34. Preferably, the hub is located adjacent bridge 30 in a bottom surface of soundboard 24. It is understood the bridge could be glued or attached to the top surface and used to anchor the strings or simply held in place by angled string pressure as found in violin family instruments, mandolins and arched top guitars. The bracing pattern is most rigid at hub 34 and progressively less rigid radially away from the bridge 30 in all directions. Hub 34 of braces 32 is located directly below bridge 30 to strengthen the bridge 30. FIG. 3 illustrates four long braces 32 or eight half braces 32 connected in at hub 34 adjacent the bridge 30. Although FIG. 3 shows an eight half brace pattern, it is understood the number of braces used could be modified to as little as two long or four half braces 36 as illustrated in FIG. 4 or to any number of braces required to balance string tension on the structure desired. The width and height of the braces may also vary. Thus, fewer stronger braces as seen in FIG. 4 could be used to provide the same balance for string tension forces. Inversely, many very small braces 32 such as illustrated in FIGS. 3 and 7 may be used.

Preferably, the braces 32 or 36 of the present invention are mirror symmetrical about an axis of symmetry 37 extending through bridge 30. This symmetry provides equalized bracing support for soundboard 24. Locating the point of intersection of braces 32 or 36 at hub 34 adjacent bridge 30 advantageously strengthens soundboard 24 near bridge 30 to reduce the likelihood that string tension will cause deformation of the soundboard 24 adjacent bridge 30.

Figure 5:
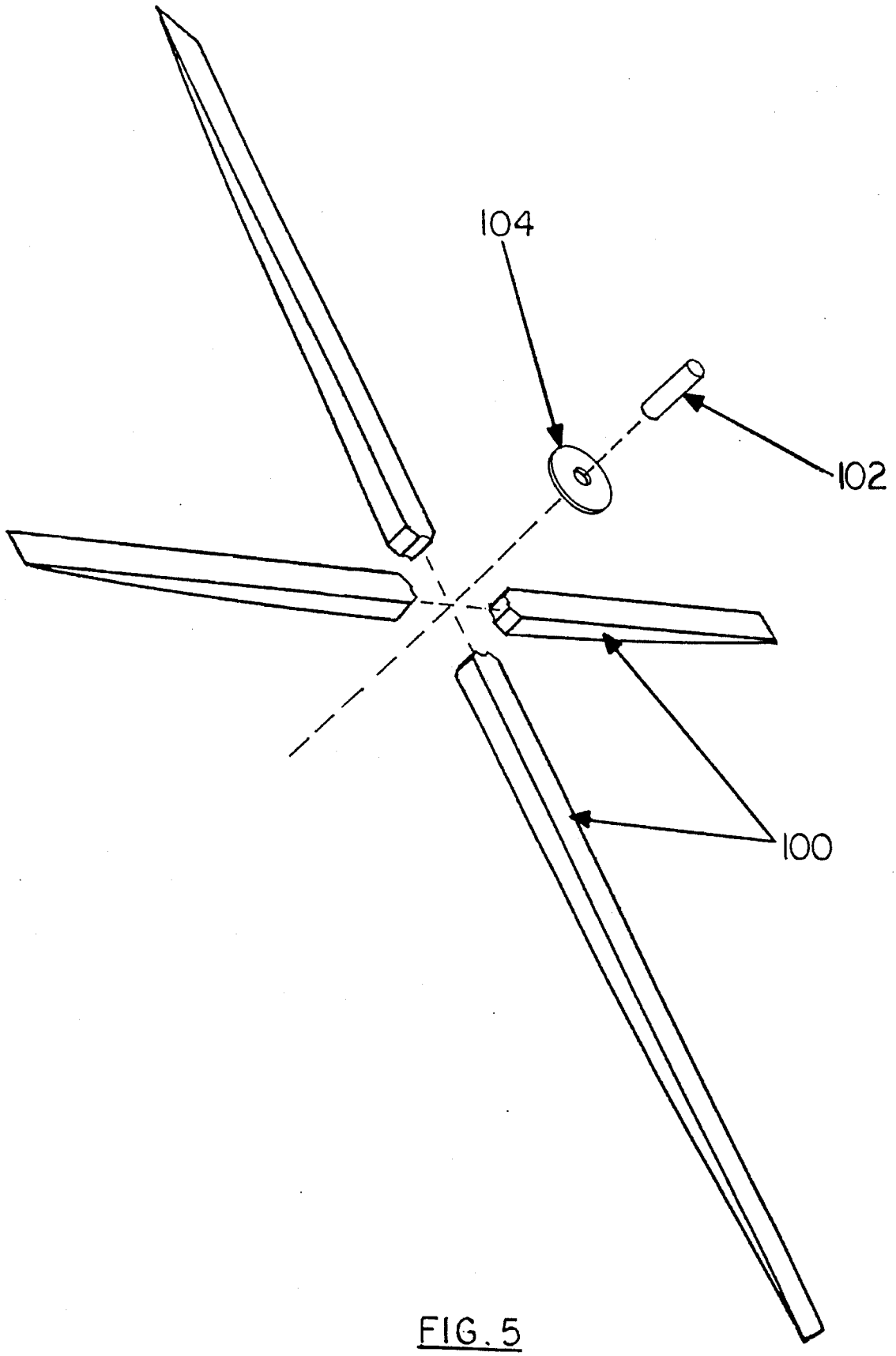
FIG. 5 is a perspective view of a hub for interconnecting a plurality of intersecting braces.

Details of the hub for interconnecting the braces 32 are illustrated in FIG. 5. When traditional tonewood is used for the braces, some reinforcement may be required at the joint of the intersection 36 (FIG. 4). FIG. 5 illustrates an embodiment of the invention that strengthens the intersection of active braces 100 with a reinforcement cap 104 and a center dowel pin 102. If the reinforcement cap 104 is to be constructed of wood, two or more laminations with the grain set at perpendicular angles will provide an extremely strong cap for the brace intersection. The dowel pin may be inserted all the way through the reinforcement cap, brace intersection, soundboard and the bridge if desired. In this configuration the bridge is more easily centered at the correct location and when glued together the bridge, soundboard, braces, and reinforcement cap become a solid unitized structure. Interconnecting hubs for injection molded plastic braces, epoxy resin or polyurethane type materials, carbon graphite or other man made materials and metals might best be molded or formed as an integral unit. Each material choice will require considerations normally associated with good engineering and design practices for each material. For example, injection molded plastic materials such as polystyrene could be used to form braces, soundboard and bridge in one integral unit. When injection molding is used braces should be not wider than the thickness of the soundboard as a rule of thumb so that 'sinks' will not appear on the top soundboard surface due to normal shrinkage that occurs when the plastic parts have been removed from their molds and allowed to cool. In this case many braces with thin width might be used rather than fewer braces.

Advantageously, thinner soundboard plates 24 may be used with the distributed load soundboard system of the present invention, thereby reducing the weight so that new efficiencies are realized. Limitations on the thickness of the working plate area in practice are related to the desired tonal character. Traditional patterns require more thickness for strength alone. The present invention frees the luthier to develop efficient loud soundboards with tonal character tuned to requirement.

Figure 6A:
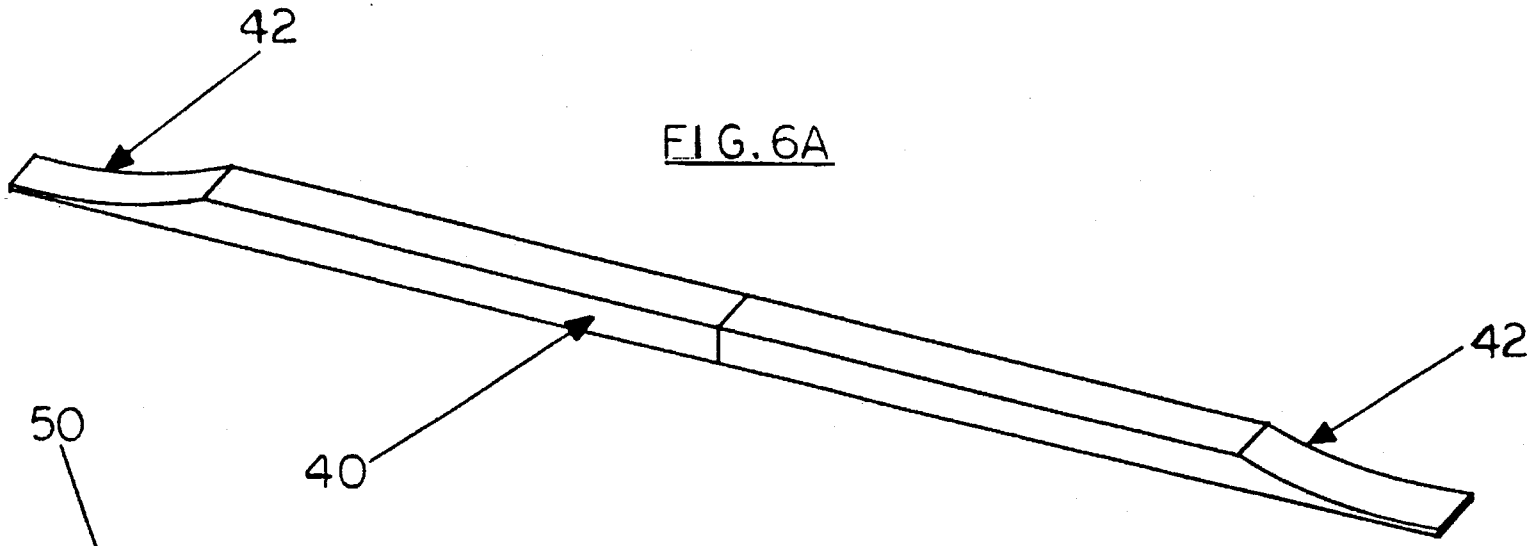
FIG. 6A is a perspective view of a traditional parallel brace.
Figure 6B:
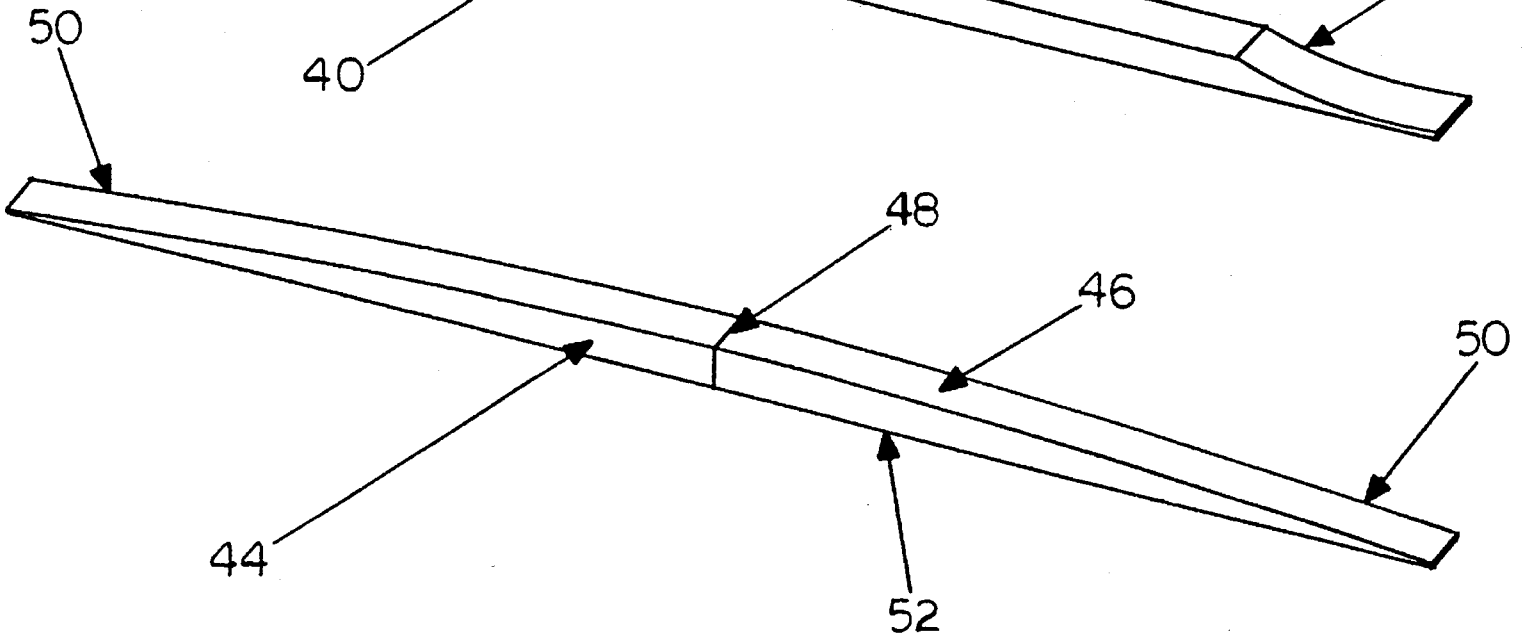
FIG. 6B is a perspective view of a catenary brace.

Even more efficiency can be realized if the active braces are studied in detail. FIG. 6A shows a traditional parallel brace 40 with the ends 42 chiseled to reduce weight somewhat. Braces 40 are found in hand made and mass manufactured instruments. FIG. 6B illustrates a brace 44 having a top surface 46 shaped to form a catenary arch.

The mathematical formula for a catenary arch is as follows: In Cartesion coordinates, the equation of a catenary that has its axis of symmetry lying along the y-axis at y=a, is $$y=(a/2)(e^{x/a}+e^{-x/a})$$

The catenary brace 44 provides the most even distribution of load with the least amount of mass. In practice these catenary braces 44 allow a considerable decrease in weight from the traditional braces 40. When flexed, the catenary brace 44 becomes a spring that has more resistance at the center 48 and gradually less resistance nearer the ends 50.

Catenary braces 44 may be used in two methods. First, the catenary braces 44 may be used with the flat side 52 of brace coupled to the soundboard 24. The catenary braces 44 can also be used with the catenary side 46 of brace 44 coupled to the soundboard 24. This second method allows for an extremely thin soundboard 24 to be bent or carved over the braces to form a catenary vaulted arch which also has the property of the bracing pattern of being more rigid at the center and progressively less rigid out away from the bridge. The distributed load soundboard system of the present invention built with catenary braces 44 coupled to the soundboard 24 as to form a catenary vaulted arch provides improved load distribution from string tension forces while reducing weight.

It is understood braces may also be constructed with an additional catenary surface instead of a flat surface on one side. The curve of the catenary for each side may be the same or different for each. Braces may also be constructed to gradually taper or to use an arc of a circle, parabola or other curves. It is understood that braces 40 or 44 are coupled to soundboard 24 in a conventional manner such as gluing. It is further understood that soundboard 24 and braces 32 in FIG. 3 or 36 in FIG. 4 may be formed integrally from molded plastic material, expanded polystyrene plastic ridged foam, carbon graphite, polyurethane or epoxy material compounds or metal material. In addition, the braces may be located on the same side of the soundboard as the bridge 30. In this instance, the hub of the braces may be used as the bridge. Violin family instruments and other arch top instruments, including mandolin and arch top guitar, frequently have bridges constructed with two feet, one for treble and one for bass. It is understood that in this instance, one hub can be located under the base foot and another hub can be located under the treble foot. A plurality of braces can be configured to intersect at each hub in a manner as illustrated in any of the single hub embodiments disclosed herein.

Figure 1:
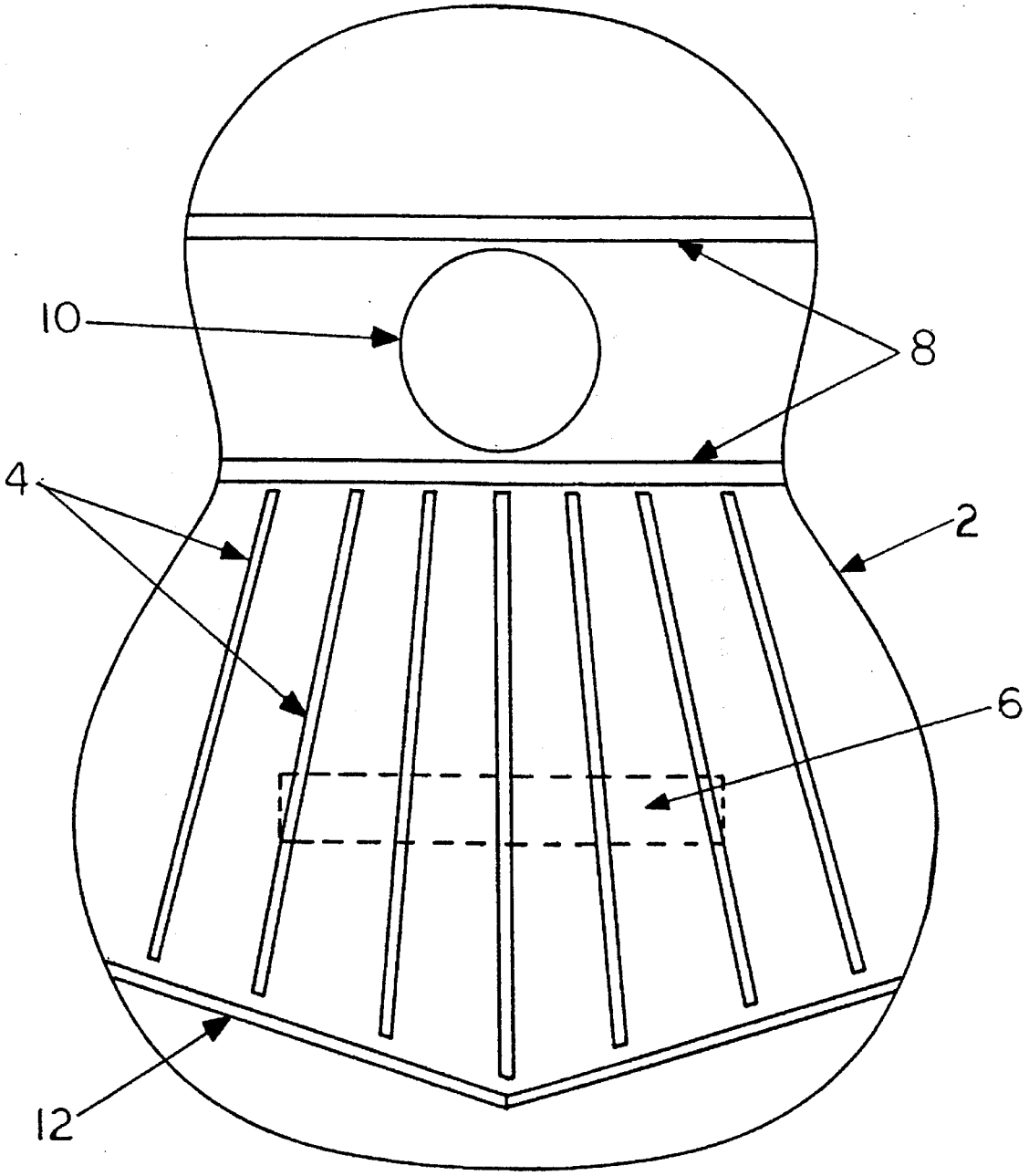
PRIOR ART FIG. 1
FIG. 1 is a plan view of a conventional fan braced soundboard.
Figure 2:
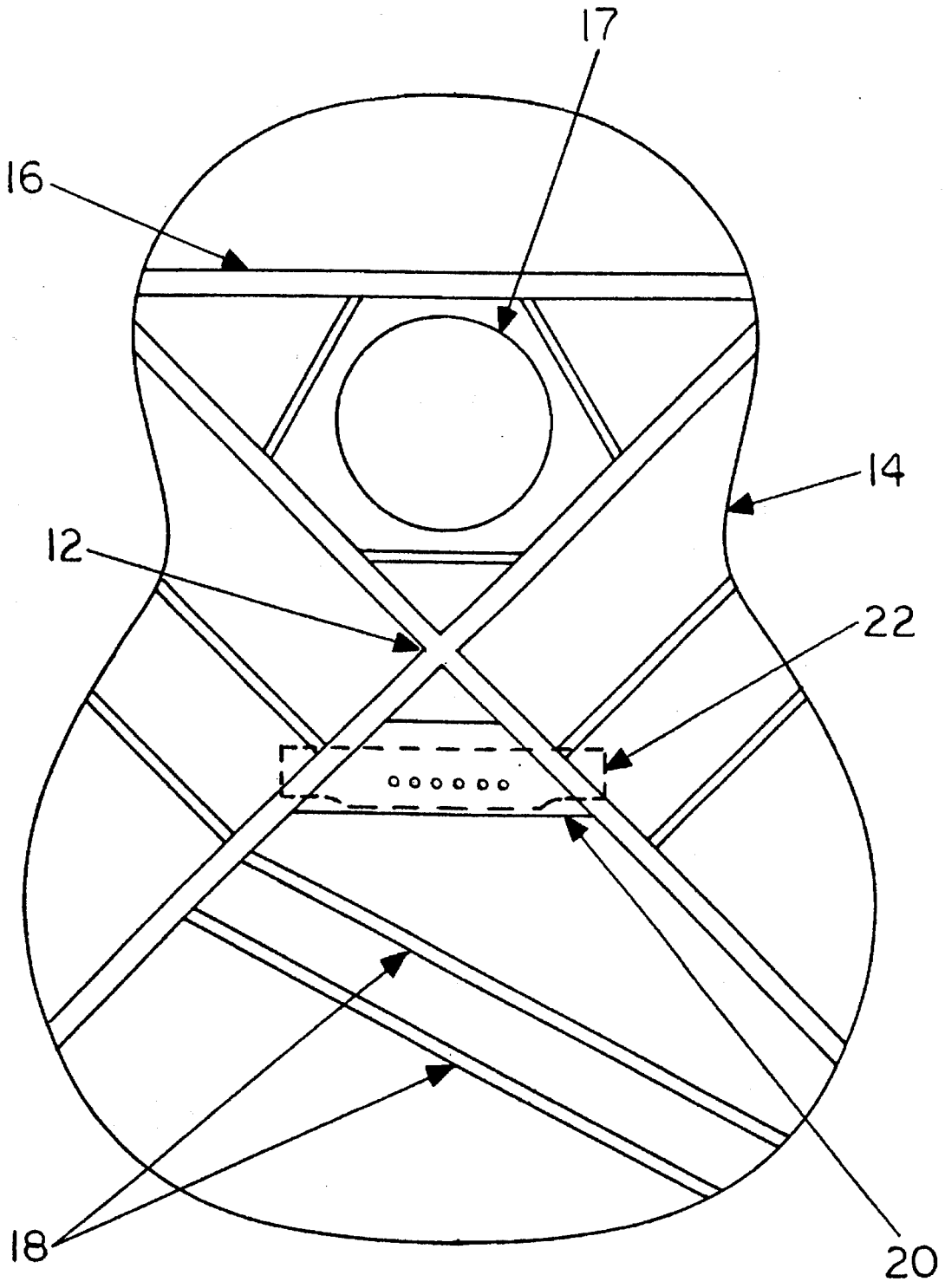
PRIOR ART FIG. 2
FIG. 2 is a plan view of a conventional X-braced soundboard.

FIGS. 7–11 illustrate a sliding adjustable neck mount system of the present invention for use with guitar, mandolin and violin family instruments. The neck 54 of the instrument is removable and mounted to the instrument body 56 by means of a male dovetail 58 which is slidably adjustable within a female dovetail socket 60. FIG. 7 shows an exploded perspective view of an instrument with removable neck 54 where a distributed load soundboard 24 of FIG. 1 is mated to the ribs and back of the body 56 of the instrument. Note that clearance opening 62 is provided in the soundboard 24 so that the removable and adjustable neck 54 may be installed. Neck 54 is installed into body 56 by inserting male dovetail 58 into female dovetail socket 60 in the direction of arrow 64 in FIG. 8. Advantageously, neck 54 can then be adjusted in the directions of arrows 66 and 68 in FIG. 9 by sliding male dovetail 58 within female dovetail socket 60.

Figure 8:
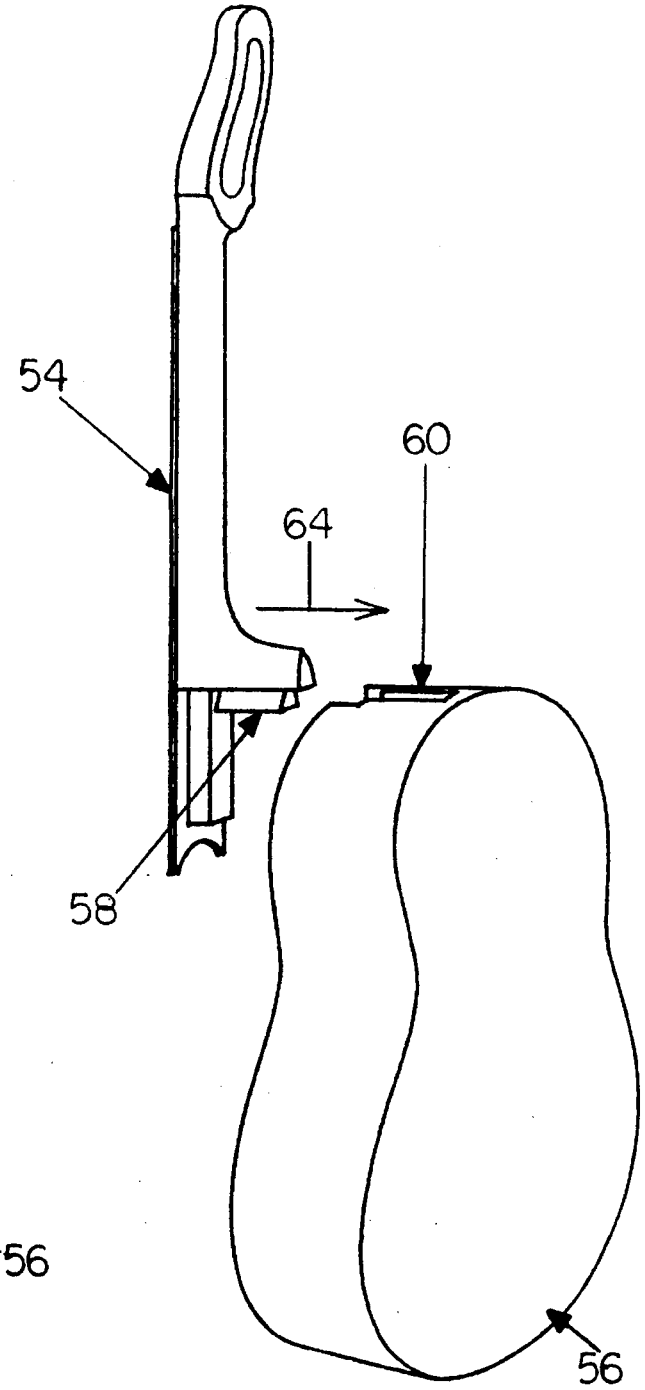
FIG. 8 is a perspective view illustrating insertion of the neck having an adjustable sliding locking mechanism of the present invention for adjusting the position of the neck relative to the body.
Figures 10, 11:
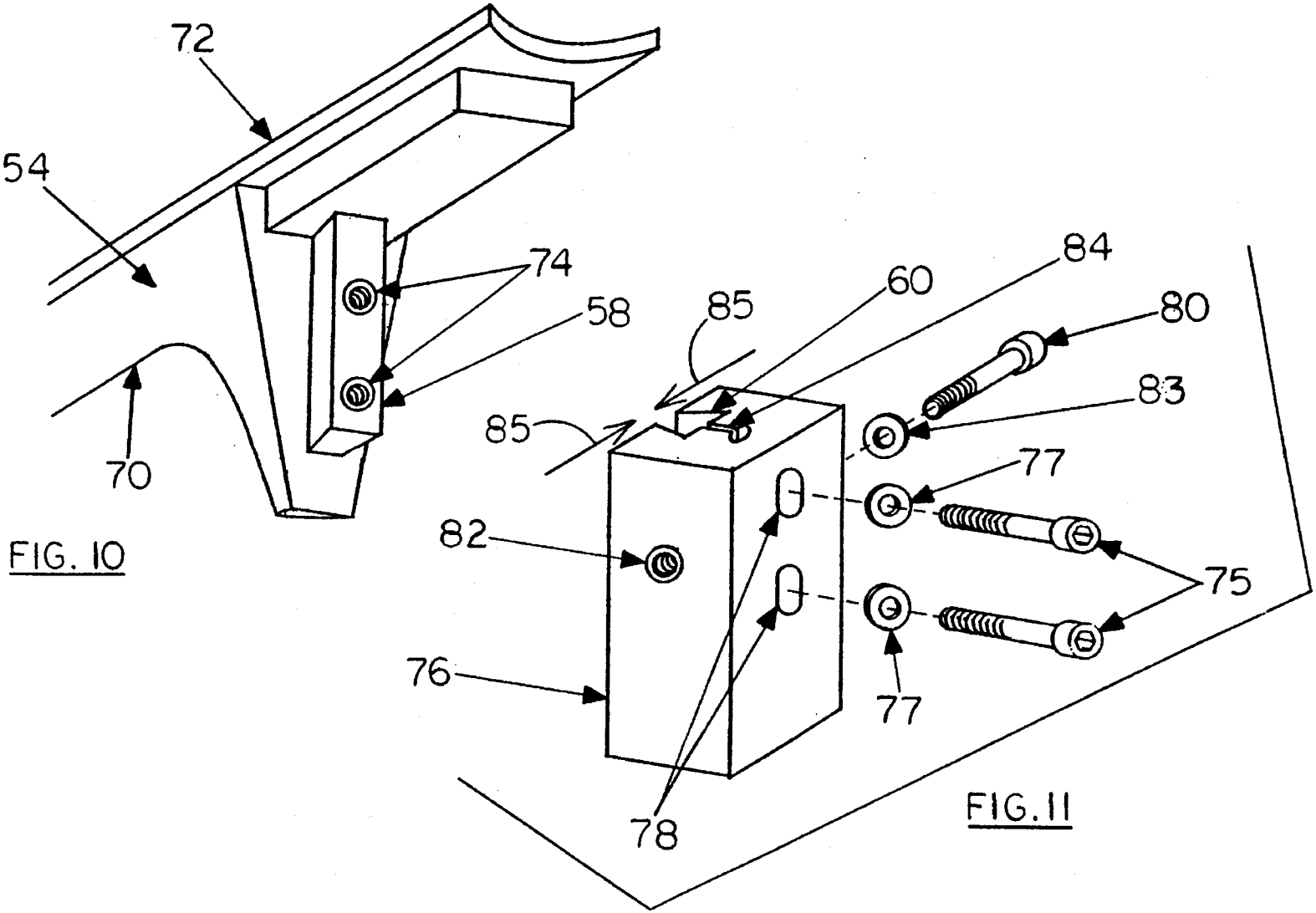
FIG. 10 is a perspective view of a male dovetail connection coupled to the neck.
FIG. 11 is a perspective view of a neck mount block including a female dovetail socket for receiving the male dovetail.

Details of the neck adjustment mechanism are illustrated in FIGS. 10 and 11. FIG. 10 illustrates a male portion of the neck adjustment mechanism in detail. The round of the neck is illustrated at 70. The fretboard or fingerboard is illustrated at location 72. Threaded inserts 74 are located in male dovetail 58. Threaded inserts 74 receive slide lock bolts 76 illustrated in FIG. 11 once the male dovetail 58 is slid into the dovetail socket 60 of neck mount block 76 illustrated in FIG. 11. Neck mount block assembly 76 is located within the body 56 of the instrument as illustrated in FIG. 8. Bolts 75 extend through elongated slots 78 and thread into inserts 74. Washers 77 are also provided. Sliding movement of male dovetail 58 in the socket 60 is limited by elongated lock bolt slots 78 illustrated in FIG. 11. In other words, elongated slots 78 permit movement of bolts 75 coupled to threaded inserts 74 relative to mount block 76. After the position of male dovetail 58 within socket 60 is established, bolts 75 are tightened to secure neck 54 relative to mount block 76 located in body portion 56. Clearance and clamping of the dovetail socket 60 is adjusted by means of the clamping bolt 80 as it is tightened or loosened from a threaded insert 82 located in the neck mount block 76. A washer 83 is provided for bolt 80. The neck mount block 76 is designed to allow for tightening of the dovetail socket 60 around male dovetail 58 when the clamping bolt 80 is tightened due to a relief slot 84 formed in block 76. In other words, tightening bolt 80 causes a clamping force by block 76 in the directions of arrows 85. Although a sliding dovetail joint is illustrated in the preferred embodiment, it is understood that other types of slidable track members may be used in accordance with the present invention.

The removable sliding neck mount system is used to assist with the balancing of string tension loads for the distributed load soundboard invention. Very slight adjustments in bridge height will change the overall loading of the distributed load soundboard. If the soundboard 24 is not balanced because of too much string tension the bridge may be lowered slightly to relieve tension and return the soundboard 24 to balance. If the bridge is lowered, the strings may become too close to the fretboard or fingerboard 72 so that rattles or buzzing may take place. With the sliding dovetail neck mount system, the sliding lock bolts 75 and clamping bolt 80 are loosened so that the neck 54 may be slipped down into the body 56 of the instrument a slight amount in the direction of arrow 68 in FIG. 8 so that the correct string height may be set between the strings and the fingerboard or fretboard 72. Once the adjustments are done, the slide lock bolts 75 and clamping bolt 80 are tightened to lock the neck 54 into place relative to body 56. Inversely, more tension can be added to the soundboard if required by slightly raising the bridge and then sliding the adjustable neck mount up in the direction of arrow 66 of FIG. 8 until the correct string height is again set.

Manufactures of string sets for stringed instruments often make their strings available to musicians calibrated to provide high tension, medium tension, or low tension because traditional instruments can be deformed or damaged if strings are applied with too high of tension.

Frequent complaints of todays musicians revolve around the issues of attempting to obtain maximum volume and tone from their traditional instruments through the selection of the correct string tension for their instrument. Musicians like instruments that play easily with correct string height loud volume and full tonal response. All too often sacrifices have to be made. Light gauge strings are easy on the hands but may not put enough energy into the instrument to provide the desired volume. If the fixed neck angle on the instrument is incorrect then little can be easily done to allow the bridge to be raised to balance the soundboard with light gauge strings without causing the string height to be too high so as to make the instrument hard to play. So the choice is most likely to be an increase in string tension by choosing a string set with higher tension. Higher tension strings can sometimes make the instruments feel tight or begin to pull the bridge forward or begin to warp the neck of the instrument.

The combination of the present invention including a adjustable sliding neck mount combined with a distributed load soundboard gives the musician the choice of string tension he desires for the feel of the strings. If higher tension strings are chosen, then the bridge can be adjusted down along with the neck to provide the perfect string height and string feel while setting the soundboard into correct balance so that the instrument will play at its loudest volume with the selected strings. If lower tension strings are desired, the bridge and neck can be adjusted up so that the maximum volume can be obtained with the lower gauge strings while maintaining correct string height.

Figure 12:
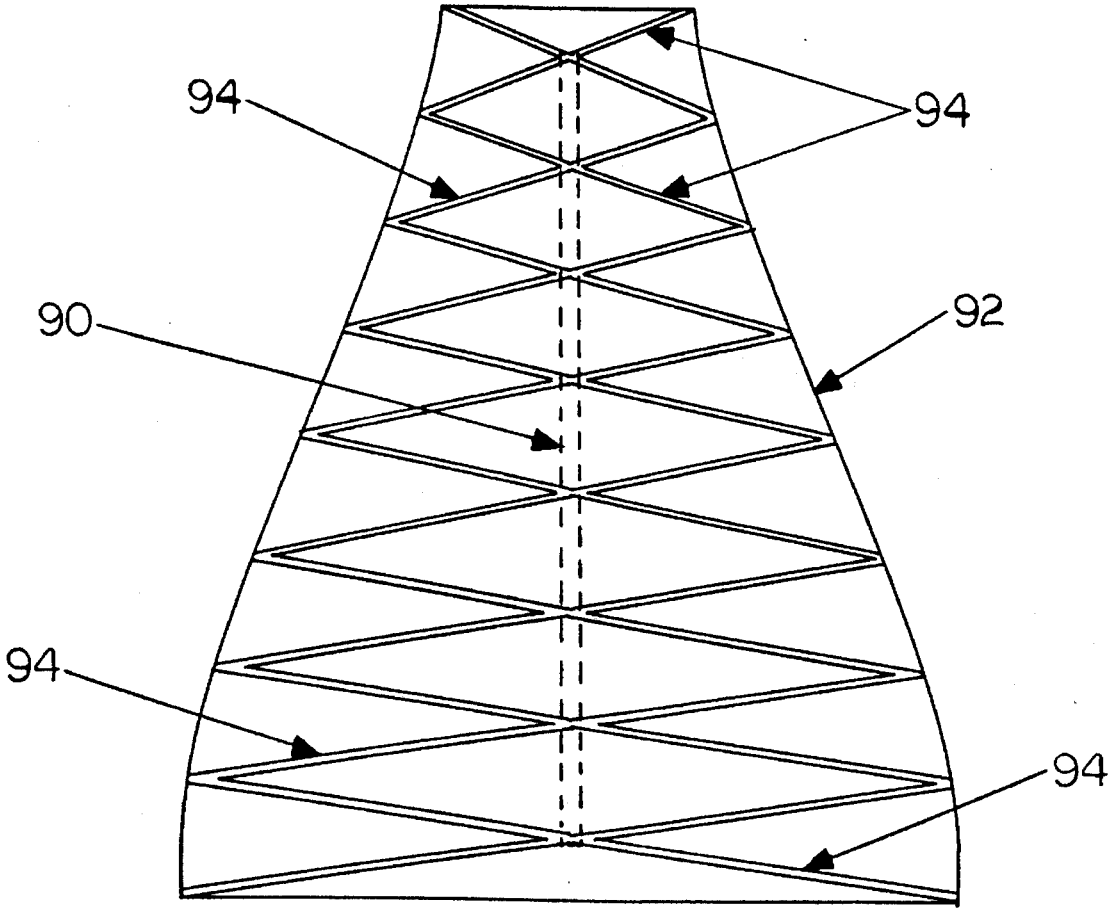
FIG. 12 is a plan view of another embodiment of the distributed load soundboard system for use with a piano, harp, or harpsichord soundboard and bridge.

The distributed load soundboard system of the present invention is also suitable for piano, harpsichord, and harp family instruments. FIG. 12 illustrates a frequency contoured soundboard invention designed to accept many strings. Unlike current piano and harpsichord soundboards, the new distributed load piano and harpsichord bridge 90 is built straight down a center portion of the soundboard 92.

This of course means that strong frames will be designed to accommodate. The bridge 90 of the soundboard 92 is supported by intersecting braces 94. The grain of the wood in the soundboard plate 92 runs generally perpendicular to the bridge 90.

The soundboard braces 94 may be constructed with traditional parallel sided braces 40 or catenary braces 44. Catenary braces 44 may be installed with flat side 52 to the soundboard 92 or catenary side 86 to the board 92 which would mean that the soundboard 92 would be bent or carved to match the braces 44. The height of the bridge may be uniform or the bridge could be built so that it is higher for the lower frequencies and gradually gets lower to the soundboard 92 for the higher frequencies. This gradually decreasing bridge 90 could give the longer sustains possible with existing plucked instruments for the high frequencies of instruments like the piano.

Figure 13:
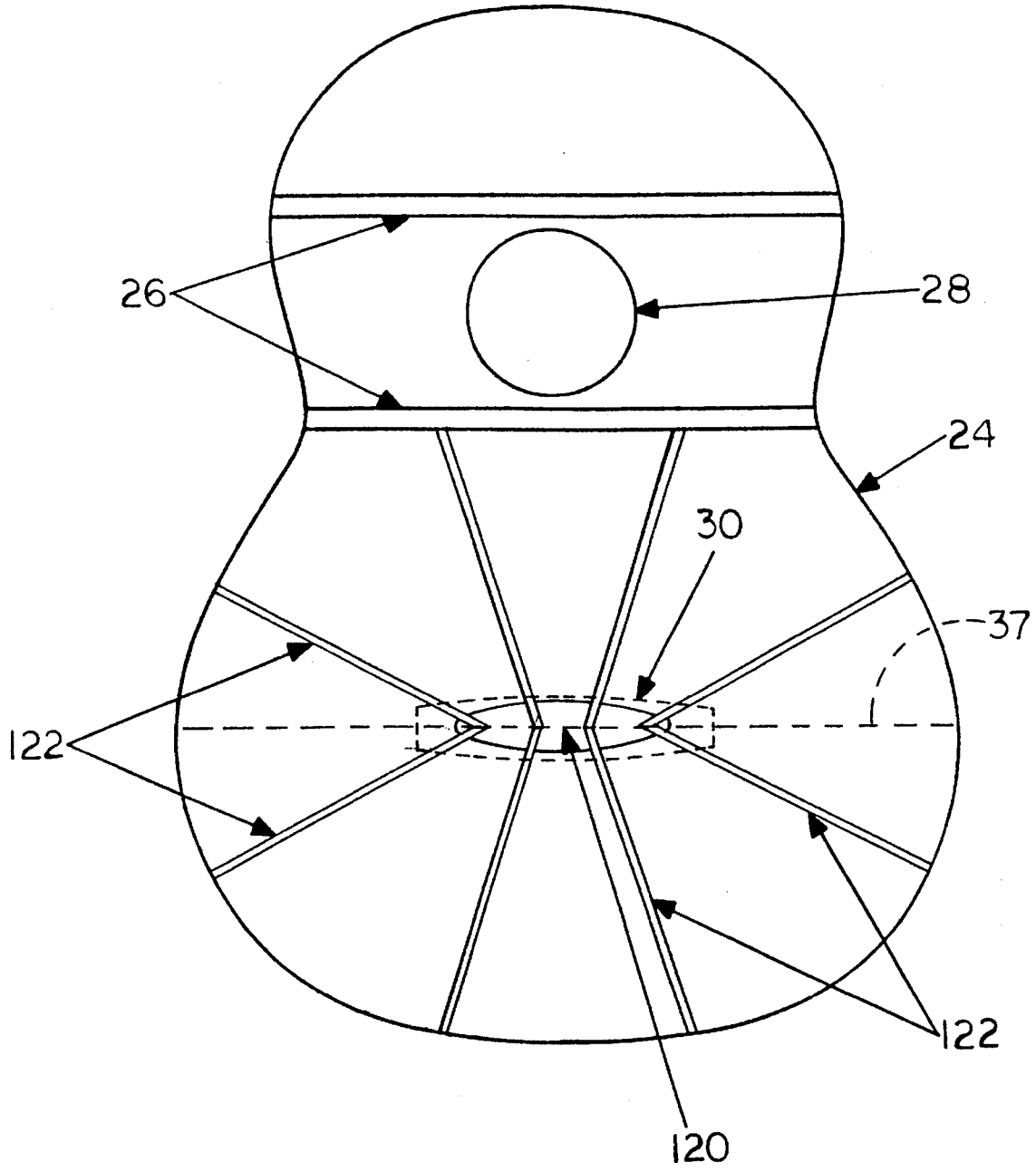
FIG. 13 is a plan view of another embodiment of the present invention.

Another embodiment of the present invention is illustrated in FIG. 13. An elongated hub 120 is located below bridge 30. Hub 120 may be larger, smaller, or the same size or shape as bridge 30. A plurality of half braces 122 are configured to intersect at hub 120 so that half braces 122 are mirror symmetrical about axis 37.

Although the invention has been described in detail with reference to a certain preferred embodiment, variations and modifications exist within the scope and spirit of the present invention as described and defined in the following claims.

What is claimed is:

1. A soundboard apparatus for a stringed musical instrument, the apparatus comprising:

a soundboard formed to include a soundhole;

an acoustic stop coupled to the soundboard to define an active portion of the soundboard on an opposite side of the acoustic stop from the soundhole;

a bridge coupled to the active portion of the soundboard for securing a plurality of strings to the soundboard;

a plurality of braces coupled to the active portion of the soundboard, the plurality of braces being configured to intersect at a point located directly below the bridge to strengthen the soundboard adjacent the bridge; and a cap coupled to and overlapping a portion of each of the plurality of braces to reinforce the braces.

2. The apparatus of claim 1, wherein the soundboard has first and second side surfaces, the bridge is coupled to the first side surface of the soundboard, and the plurality of braces are coupled to the second side surface of the soundboard.

3. The apparatus of claim 2, wherein the plurality of braces are catenary braces having a generally flat side surface and a curved catenary side surface, the generally flat side surfaces of the plurality of catenary braces being coupled to the second surface of the soundboard.

4. The apparatus of claim 2, wherein the plurality of braces are catenary braces having a generally flat side surface and a curved catenary side surface, the curved catenary side surfaces of the plurality of catenary braces being coupled to the second surface of the soundboard.

5. The apparatus of claim 1, wherein the plurality of braces are mirror symmetrical about an imaginary axis of symmetry, said axis of symmetry extending through the bridge.

6. The apparatus of claim 1, wherein the stringed musical instrument includes a neck and a body, and further comprising a first track member located on the neck, a second track member located on the body, the second track member being formed to slidably engage the first track member to align the neck in a selected position relative to the body, and a fastener for holding the first and second track members in the selected position to secure the neck relative to the body.

7. The apparatus of claim 6, wherein the first track member includes a male dovetail coupled to the neck and the second track member includes a mount block coupled to the body, the mount block being formed to include a female dovetail groove for slidably receiving the male dovetail.

8. The apparatus of claim 1, wherein the soundboard and the plurality of braces are integrally formed as a one-piece unit.

9. The apparatus of claim 1, further comprising a pin located between the soundboard and the cap adjacent the point of intersection of the plurality of braces to further reinforce the braces.

10. The apparatus of claim 1, wherein each of the braces includes an end portion having a pair of angled surfaces configured to abut an angled surface of an adjacent brace to form a substantially continuous hub at the point of intersection of the plurality of braces.

11. The apparatus of claim 1, wherein at least six half braces are coupled to the soundboard, the at least six half braces being configured to intersect at a hub.

12. A soundboard apparatus for a stringed musical instrument, the apparatus comprising:

a soundboard having first and second side surfaces;

a bridge coupled to the first side surface of the soundboard for securing a plurality of strings to the soundboard; and at least two catenary braces coupled to the second side surface of the soundboard to strengthen the soundboard, the catenary braces being configured to intersect at a hub located below the bridge to strengthen the soundboard adjacent the bridge.

13. The apparatus of claim 12, wherein the plurality of catenary braces each have a generally flat side surface and a curved catenary side surface, the generally flat side surfaces of the plurality of catenary braces being coupled to the second surface of the soundboard.

14. The apparatus of claim 12, wherein the plurality of catenary braces each have a generally flat side surface and a curved catenary side surface, the curved catenary side surfaces of the plurality of catenary braces are coupled to the second surface of the soundboard.

15. The apparatus of claim 12, wherein the plurality of catenary braces are mirror symmetrical about an imaginary axis of symmetry, said axis of symmetry extending through the bridge.

16. The apparatus of claim 12, wherein the stringed musical instrument includes a neck and a body, and further comprising a first track member located on the neck, a second track member located on the body, the second track member being formed to slidably engage the first track member to align the neck in a selected position relative to the body, and a fastener for holding the first and second track members in the selected position to secure the neck relative to the body.

17. The apparatus of claim 16, wherein the first track member includes a male dovetail coupled to the neck and the second track member includes a mount block coupled to the body, the mount block being formed to include a female dovetail groove for slidably receiving the male dovetail.

18. The apparatus of claim 12, further comprising a cap coupled to the hub, the cap being configured to overlap a portion of the at least two catenary braces to reinforce the braces.

19. The apparatus of claim 12, wherein at least six half braces are coupled to the soundboard, the at least six half braces being configured to intersect at a hub.

20. An adjustable locking apparatus for securing a neck to a body of a stringed musical instrument, the apparatus comprising:

a first track member located on the neck;

a second track member located on the body, the second track member being formed to slidably engage the first track member to align the neck in a selected position relative to the body; and a fastener for holding the first and second track members in the selected position to secure the neck relative to the body without gluing the first and second track members together when the fastener is tightened, the position of the neck relative to the body being adjustable when the fastener is loosened to permit the first track member to slide relative to the second track member.

21. The apparatus of claim 20, wherein the first track member includes a male dovetail coupled to the neck and the second track member includes a mount block coupled to the body, the mount block being formed to include a female dovetail groove for slidably receiving the male dovetail.

22. The apparatus of claim 21, wherein the fastener includes at least one bolt extending through the mount block and engaging a threaded insert in the male dovetail to secure the male dovetail relative to the mount block.

23. The apparatus of claim 21, further comprising a relief slot formed in the mount block adjacent the female dovetail groove and a clamping bolt for engaging the mount block to adjust a clamping force applied by the dovetail groove against the male dovetail.

24. The apparatus of claim 21, wherein the mount block is formed to include at least one elongated slot, each elongated slot being configured to receive a fastener therethrough, each fastener being configured to engage a threaded insert in the male dovetail to secure the mount block relative to the male dovetail, each fastener being slidable in the at least one elongated slot to permit adjustment of the position of the neck relative to the body.

25. The apparatus of claim 20, further comprising a soundboard configured to be coupled to the body of the musical instrument, a bridge coupled to a first side surface of the soundboard for securing a plurality of strings to the soundboard, and a plurality of braces coupled to a second side surface of the soundboard, the plurality of braces being configured to intersect at a point located directly below the bridge to strengthen the soundboard adjacent the bridge.

26. The apparatus of claim 25, wherein the plurality of braces are catenary braces having a generally flat side surface and a curved catenary side surface, the generally flat side surfaces of the plurality of catenary braces being coupled to the second surface of the soundboard.

27. The apparatus of claim 25, wherein the plurality of braces are catenary braces having a generally flat side surface and a curved catenary side surface, the curved catenary side surfaces of the plurality of catenary braces being coupled to the second surface of the soundboard.

28. The apparatus of claim 25, wherein the plurality of braces are mirror symmetrical about an imaginary axis of symmetry, said axis of symmetry extending through the bridge.

* * * * *